US006427284B1

(12) United States Patent
Harrelson, II et al.

(10) Patent No.: US 6,427,284 B1
(45) Date of Patent: Aug. 6, 2002

(54) CENTRAL VACUUM HOSE STORAGE

(75) Inventors: Clyde W. Harrelson, II, Burgaw; Clyde W. Harrelson, III, Hampstead; William R. Jones, Jr., Wilmington, all of NC (US)

(73) Assignee: Vacs America, Inc., Burgaw, NC (US)

( * ) Notice: Subject to any disclaimer, the term of this patent is extended or adjusted under 35 U.S.C. 154(b) by 0 days.

(21) Appl. No.: 09/742,773

(22) Filed: Dec. 20, 2000

(51) Int. Cl.[7] ..... A47L 9/00
(52) U.S. Cl. ..... 15/315; 15/323; 137/355.16
(58) Field of Search ..... 15/315; 137/355.16, 137/360

(56) References Cited

U.S. PATENT DOCUMENTS

| | | | | |
|---|---|---|---|---|
| 3,353,996 A | | 11/1967 | Hamrick | |
| 3,464,859 A | | 9/1969 | Hamrick | |
| 3,520,725 A | | 7/1970 | Hamrick | |
| 3,568,240 A | | 3/1971 | Hamrick | |
| 3,958,297 A | | 5/1976 | Hukuba et al. | |
| 3,977,037 A | | 8/1976 | Miyake et al. | |
| 3,977,038 A | | 8/1976 | Hukuba et al. | |
| 4,246,675 A | | 1/1981 | Costanzo | |
| 4,688,292 A | | 8/1987 | Schmiegel | |
| 5,402,551 A | | 4/1995 | Workhoven et al. | |
| 5,430,978 A | | 7/1995 | Kohler | |
| 5,526,842 A | | 6/1996 | Christensen | |
| 5,740,581 A | * | 4/1998 | Harrelson, II | 137/355.16 |
| 6,120,615 A | * | 9/2000 | Fletcher | 134/21 |
| 6,182,327 B1 | * | 2/2001 | Gosselin | 137/355.16 |

* cited by examiner

*Primary Examiner*—Chris K. Moore
(74) *Attorney, Agent, or Firm*—MacCord Mason PLLC

(57) ABSTRACT

A vacuum hose storage unit for insertion within a wall is described that includes a housing with a nozzle/retractor compartment and a hose storage compartment. An opening in the hose storage compartment is in communication with an external conduit leading to a remote vacuum source. Initially, the housing can be used to connect a separately stored hose to the vacuum source by positioning an inlet connector in the nozzle/retractor compartment, and connecting an internal conduit from the inlet connector to the opening in the hose compartment. Subsequently, the internal conduit can be replaced with a hose that is stored in the hose storage compartment and a retractor to extend the hose through the nozzle/retractor compartment. One part of the nozzle/retractor compartment can be covered with a wall covering, with the retractor being inserted into another part of the nozzle/retractor compartment and then moved behind the wall covering.

18 Claims, 4 Drawing Sheets

CENTRAL VACUUM HOSE STORAGE

BACKGROUND OF THE INVENTION (1) Field of the Invention

The present invention relates generally to central vacuum systems, and in particular to a storage unit for housing a central vacuum hose within a building wall.

(2) Description of the Prior Art

Central vacuum systems are normally installed in buildings during building construction, and are comprised of a remotely located vacuum source that includes a powered vacuum unit and canister or other debris receptacle, and conduits within the building walls connecting the vacuum unit to inlets at various locations within the building. When a given area is to be vacuumed, a flexible hose is attached at its proximal or connector end to a nearby inlet. Connection of the hose to the inlet closes a circuit to the vacuum unit, causing a vacuum to be drawn through the connecting conduit and the hose, so that debris will be drawn into the nozzle attached to the distal end of the hose.

One of the problems with central vacuum units is the inconvenience attendant to storing the detachable vacuum hose when it is not in use, and in moving the hose from area to area during vacuuming. Various solutions have been proposed in the prior art to address this problem. For example, U.S. Pat. Nos. 5,740,581 and 5,740,582 to Harrelson, II, both issued Apr. 21, 1998, and assigned to the assignee of this invention, describe an in-wall system with a cabinet having one compartment to enclose a vacuum unit and a debris receiving receptacle, and a hose storage compartment that includes a reversible drive unit for extending and retracting the hose. The upper area of the cabinet includes a door for access to a hose nozzle connected to the distal end of the flexible hose, which has its proximal end connected to the vacuum unit. The cabinet is sized to fit between adjacent wall studs.

When using the device described in the Harrelson, II patents, the user opens the door in the upper part of the cabinet and grasps the hose nozzle, which includes a switch with forward-stop-reverse positions in circuit with the drive unit. The drive unit includes drive rollers that exert pressure on either side of the hose, which extends from its storage compartment between the nip of the drive rollers. When the user moves the switch to the "forward" position, the drive rollers turn to feed the hose outwardly from the cabinet until all of the hose has been extended, or until the switch is moved to the "off" position by the user. After vacuuming, the user moves the switch to "reverse", rotating the rollers in the opposite direction to return the hose to its storage compartment.

The Harrelson central vacuum system has proven to be of considerable utility when installed in buildings or other structures where the area to be vacuumed does not extend beyond the length of the hose that can be practically stored in the hose storage compartment, e.g., about 30–35 feet. However, installation of multiple units is required if a greater area or multiple areas are to be vacuumed.

In structures where cost is a significant factor, such as in prefabricated homes, installation of multiple self-contained units may be cost prohibitive. In these structures, there is still a need for an economical vacuum system that provides for hose storage. A system that provides for hose storage that could be partially installed during building construction, with the hose and drive system being subsequently installed, thereby minimizing the initial investment, would be especially desirable.

SUMMARY OF THE INVENTION

The present invention addresses these needs by providing a vacuum hose storage and retractor unit that is positionable within a wall between wall studs, and connected to a remotely located vacuum source. The hose storage unit is comprised of a housing, with a hose and hose retractor mountable within the housing. The unit is especially designed so that the entire unit can be installed at the time the wall is constructed, or so that the housing can be installed initially, with the hose and hose retractor being installed at a later date.

The housing can be installed between two adjacent wall studs, or between two walls studs that are separated by an intermediate stud. In the latter instance, a section of the intermediate stud in removed, or a shorter upper intermediate stud section is used, with a horizontal cross-bracing member being installed to support the intermediate stud section.

The storage unit housing is comprised of a vertical rear wall, and outer side, top and bottom walls that extend forward from the rear wall to the front of the opening. The housing is sized so that the housing side walls abut the inner faces of the studs between which the housing is positioned. Flanges may extend outwardly from the front edges of the side, top and bottom walls, and parallel to the rear wall. The flanges may be attached to the front of the studs and any cross-bracing members to secure the housing in place. The housing forms an interior chamber that is covered with doors, covers or wall material, as will be described. The housing can be fabricated of various materials, e.g., sheet metal or molded plastic. Instead of separately formed walls, studs or other framing members can serve as one or more of the walls. For example, a horizontal cross-bearing member can be used as the bottom wall.

The interior chamber of the housing is divided into a hose storage compartment and a nozzle/retractor compartment by an interior divider that extends across the interior chamber, e.g., between the inner faces of the housing side walls to form upper and lower compartments. The relative dimensions of the compartments will depend upon the overall dimensions of the housing, and the sizes of the internal components. Generally, however, the divider will section the overall housing so that the hose compartment occupies approximately 60 to 80% of the housing interior chamber.

It will be understood that the invention also contemplates construction of the housing with separately formed hose and nozzle/retractor compartments, which may be formed of the same or different materials. In this construction, the two compartments are placed adjacent each other, with their abutting walls together forming the divider. As described in the preferred embodiment, the hose compartment is shown as the lower compartment. However, it is to be understood that other configurations are also contemplated by the invention.

The housing may be used with or without the hose and retractor. In the latter configuration, the nozzle/retractor compartment is divided into a nozzle section and a connector section with an intermediate partition that includes a vacuum hose inlet connector for connecting a hose through the connector section and the hose compartment to a remote vacuum source. The connector section communicates with the hose compartment through an opening in the divider.

One of the outer walls of the hose compartment, normally one of the side walls, includes an opening to connect the unit to a conduit that is connected to the remote vacuum source. The stud adjacent this wall will also include a mating opening so that the connecting conduit can communicate with the external conduit. A connection hose or conduit extends from the outer wall opening through the hose compartment, and then through the connector section to connect the exterior conduit to the inlet connector. The hose connector can be wired in a circuit with the vacuum source in a conventional manner to energize the vacuum source when a hose is connected.

The housing without the hose and reversible drive unit, or retractor, is installed between and secured to two wall studs during wall construction. The connector section can be covered by sheet rock, dry wall or other wall surfacing material during installation, with removable covers, the term including hinged doors or plates, being placed in front of the hose compartment and the connector section. When used, the user inserts the proximal end of a hose, which is normally stored at a separate location, into the nozzle section to connect the hose to the inlet connector on the partition. As a result, the hose is connected via the connector hose to the central vacuum conduit and vacuum source, permitting use of the hose in the usual manner.

The hose and retractor can be installed in the housing when finances permit, or at the time of the initial installation. To do so, the connector conduit and the partition with the inlet connector, if previously installed, is first removed. An inlet connector, if not previously installed, is installed over the opening in the housing outer wall. The proximal end of the flexible hose is then inserted from the nozzle/retractor compartment through an opening in the divider and through the hose compartment, and is attached to the inlet connector to connect to the central vacuum conduit. The hose is also inserted through the retractor.

Generally, the reversible drive means, referred to herein as the retractor, is comprised of opposed first and second rollers that are spaced to received a hose between the nip of the rollers, and a reversible motor that is in communication with at least one of the rollers. The rollers can be supported on frame sections that are hinged to each other or to a common base to permit movement of the rollers to an open position for insertion of the hose. Preferably, one of the rollers is driven by a reversible electric motor, with the driven roller engaging the second roller when the rollers are in their closed position, thereby driving the second roller. Alternatively, both rollers can be connected directly or indirectly to the motor shaft. The retractor includes a first side that faces the nozzle section of the nozzle/retractor compartment, and a second side that faces the hose compartment.

If the housing is initially used without the hose and drive unit, the connector section may be covered by dry wall or other facing material at the time the hose and retractor is to be installed. If so, the retractor is first positioned around the hose, e.g., by opening the hinged rollers and inserting the hose into the roller nip. The proximal end of the hose is then inserted from the nozzle/retractor compartment through the opening in the divider and into the hose compartment, where the proximal end of the hose is connected to the inlet connector. The retractor is then inserted into the nozzle section and slid behind the wall facing into position in what was formerly the connector section. To facilitate insertion of the retractor with the attached hose, the opening in the divider preferably extends across the entire bottom of the connector section.

When the complete unit is used, the user grasps the nozzle stored in the nozzle section, and turns a switch to the "forward" position. This switch may be positioned on the nozzle, within the nozzle section interior, such as on an interior wall or at some other convenient location, on or adjacent the unit. Movement of the switch to the "forward" position activated the retractor motor, causing the rollers to rotate, thereby feeding the hose from the hose compartment until all of the hose is extended, or until the user moves the switch from the "forward" position. After use, the hose is returned to the hose storage compartment by moving the switch to the "reverse" position. A switch can also be included to manually start and stop the remote vacuum source.

Thus, the present invention provides a storage unit that can be used to store and dispense a flexible vacuum cleaner hose that is in communication with a remote vacuum source, with the unit housing also being useful as a means to connect a separately stored hose to the remote vacuum source prior to installation of the hose and drive unit.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
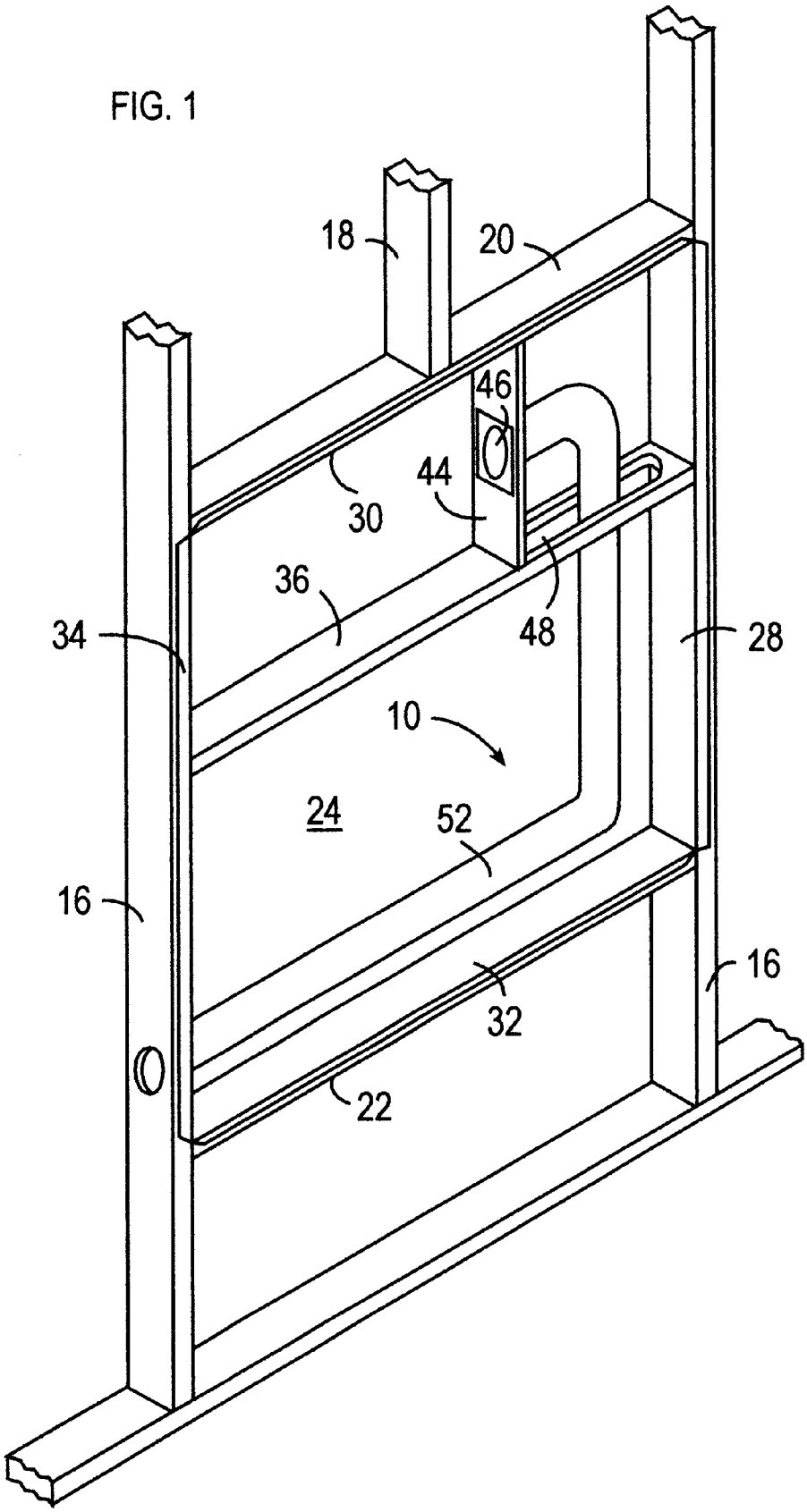
FIG. 1 is a perspective view of the housing installed in a wall without the hose and hose retractor installed, and without doors or wall covering.

The hose storage and retractor unit of the present invention is comprised of housing 10, hose 12 and hose retractor 14. FIG. 1 illustrates housing 10 installed between adjacent wall studs 16, and beneath intermediate stud section 18, with horizontal cross-bracing member 20 supporting stud section 18. A second horizontal member 22 extends between studs 16 below member 20. Housing 10 includes vertical rear wall 24, side walls 26 and 28, top wall 30 and bottom wall 32. Flanges 34 extend outwardly from the front edges of walls 26, 28, 30 and 32 to attach housing 10 to the wall studs.

Horizontal divider 36 extends between the inner faces of the side walls 26 and 28 to divide the interior of housing 12 into a lower hose storage compartment 40 and an upper nozzle/retractor compartment 42 that is separated in the embodiment shown in FIG. 1 into a nozzle side and a connector side by vertical partition wall 44 that extends between the inner face of top wall 30 and the upper surface of separator wall 36. Partition 44 includes a conventional inlet connector 46 of the type commonly used to connect hoses of central vacuum cleaners.

Divider 36 includes an opening 48 that extends from the connector side of nozzle/retractor compartment 42 into hose compartment 40. External conduit 50 extending from a remote vacuum source, not shown, to housing 10 through a hole in stud 16. Housing 10 includes an opening in side wall 26 to mate with the opening in stud 16. Inlet connector 46 is connected to conduit 50 with connector conduit 52, which extends from inlet connector 46 through opening 48 and hose compartment 40.

Thus, in the embodiment illustrated in FIG. 1, the unit serves basically as a connector for a hose that is stored at a separate location, with the separate hose being connected to inlet connector 46 when used. However, at a later time, the unit can be modified to the configuration shown in FIG. 2 by adding hose 12 and retractor 14, so that hose 12 is stored within the unit instead of at a separate location.

Figure 2:
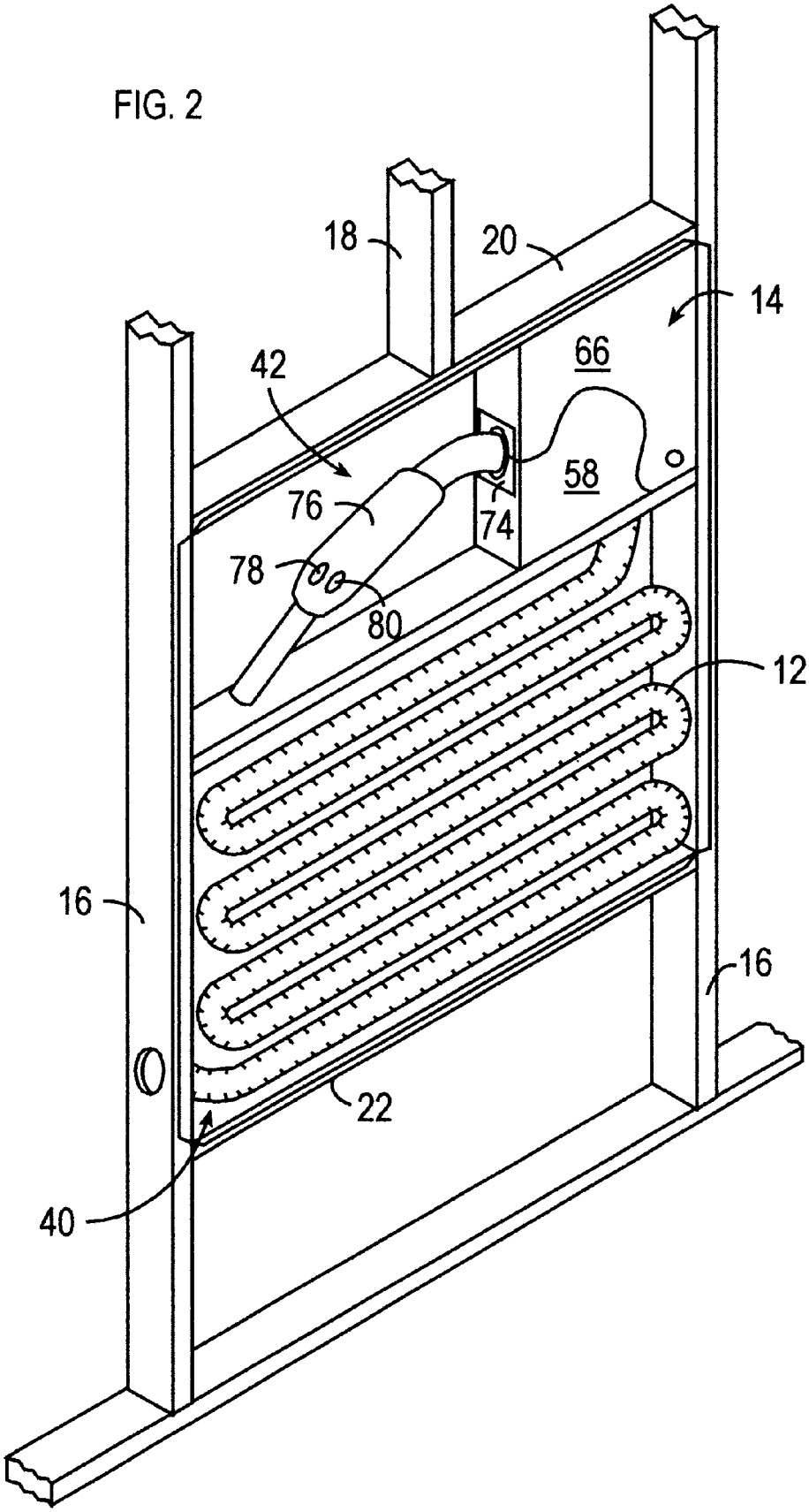
FIG. 2 is a perspective view of the housing installed in a wall with the hose and hose retractor installed, and without doors or wall covering.
Figure 3:
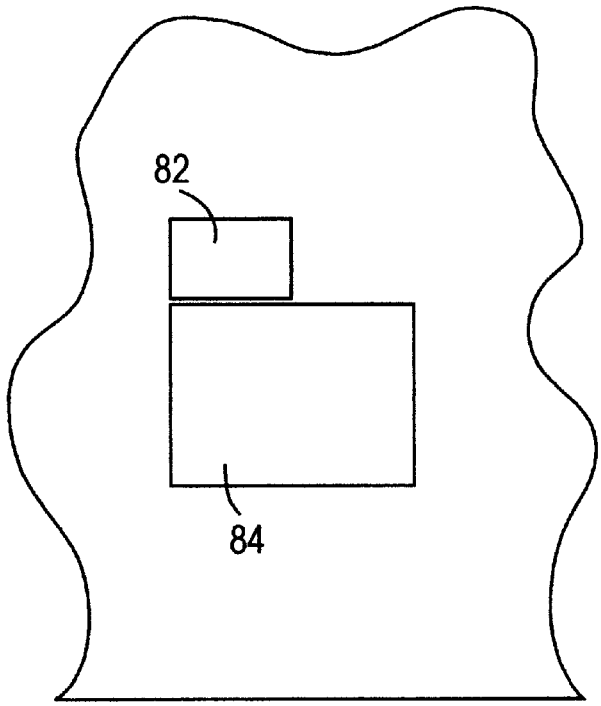
FIG. 3 is front view of the unit mounted in a wall with the doors and wall covering in place.
Figure 4:
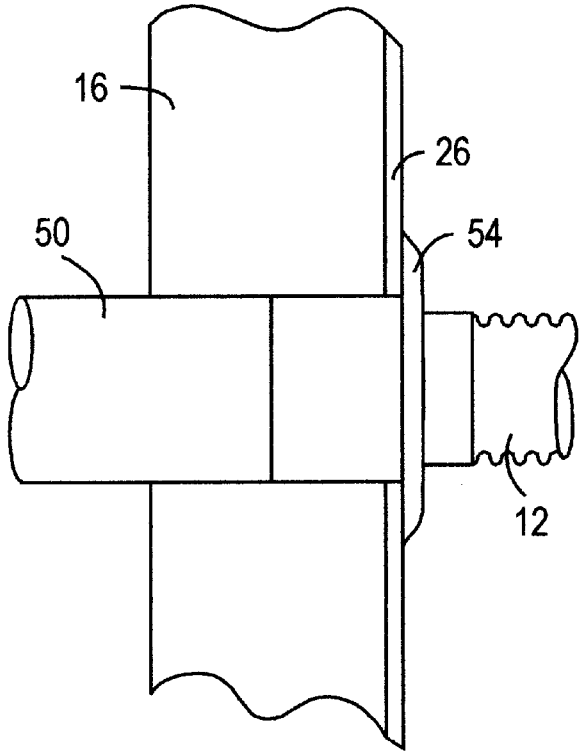
FIG. 4 is a detailed sectional side view of the connection of the hose to the external conduit.

To convert the unit as shown in FIG. 1 to the unit shown in FIG. 2, connector conduit 52 and separator wall 36 with inlet connector 46 are removed, and inlet connector 54, which may be previous connector 46, is installed over the opening in wall 26. The proximal end of flexible hose 12 is inserted from nozzle/retractor compartment 42 through divider 36 and hose compartment 40 to connect to inlet connector 54, and thus to the central vacuum source. Connection of the proximal end of hose 12 is shown in greater detail in FIG. 4.

Figure 5:
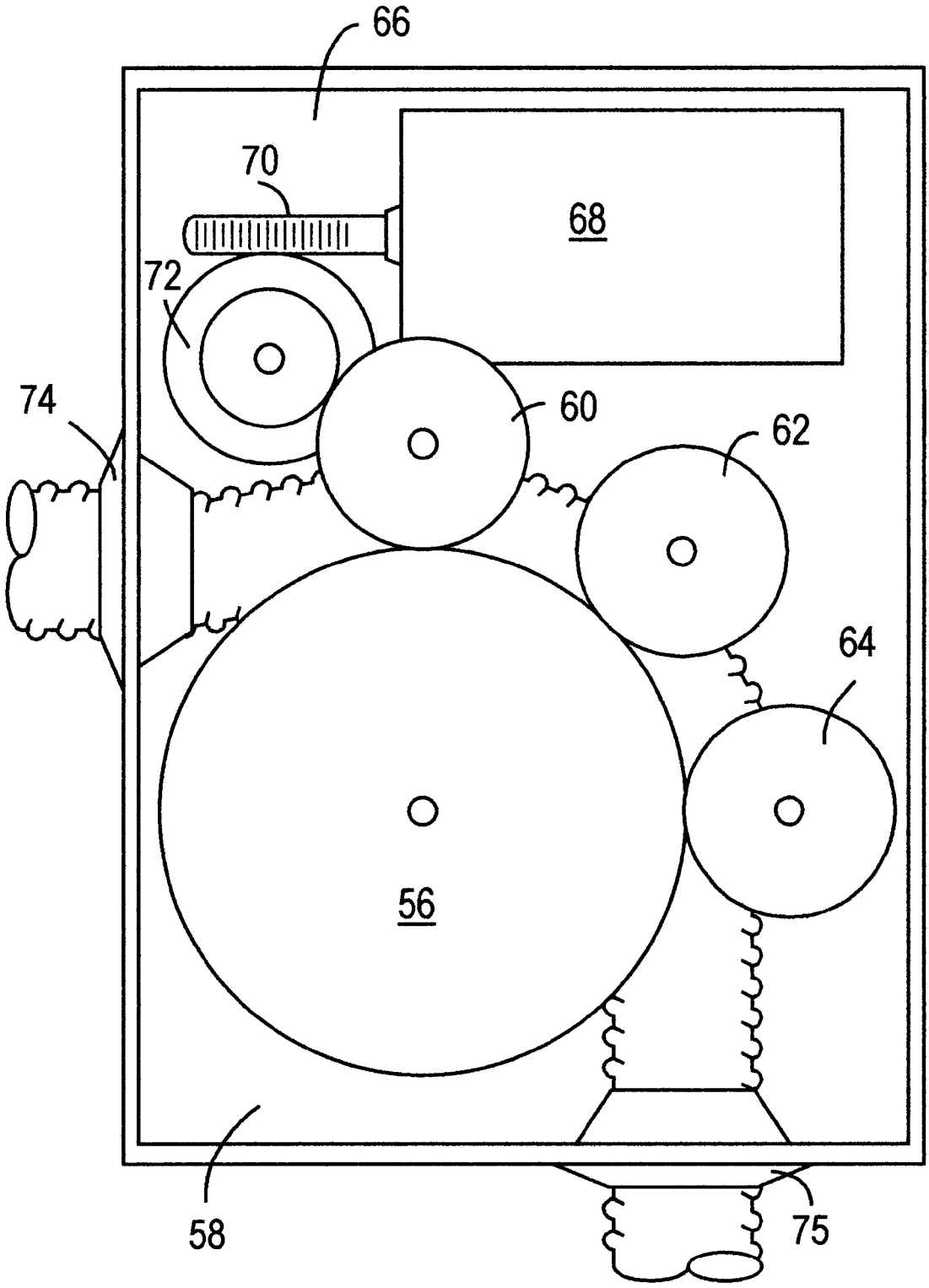
FIG. 5 is a side view of the hose retractor with the front wall sections removed to illustrate the interior components of the retractor.

Retractor 14, shown in detail in FIG. 5, is comprised of roller 56, horizontally mounted between the front and back walls of lower retractor frame section 58, and upper opposed rollers 60, 62, and 64, horizontally mounted between the front and back walls of upper frame section 66. The front walls of retractor frame sections 58 and 66 have been removed in FIG. 5 to reveal the interior of retractor 14.

Motor 68 is mounted within upper frame section 66, with motor shaft 70 being operatively connected to roller 60 through intermediate roller 72. Roller 60, in turn is operatively connected to roller 56, which is operatively connected to rollers 62 and 64. Thus, rotation of motor shaft 70 causes all rollers to turn.

Upper frame section 66 is hinged to lower frame section 58, permitting opening of the frame sections to separate the rollers for insertion of hose 12 between the nip of roller 56 and rollers 60, 62, and 64. Annular hose guides 74 and 75 extend around openings in retractor 14 toward the nozzle side of nozzle/retractor compartment 42 and the opening in divider 36, respectively. Guides 74 and 75 having a slightly greater diameter than the diameter of hose 12, so that hose 12 can be fed through guides 74 and 75 by retractor 14.

In operation, the user grasps nozzle 76 at the distal end of hose 12 and moves switch 78 to its "forward" position to feed hose 12 from hose compartment 40. A second switch 80 may be used to activate the remote vacuum source. After vacuuming is completed, the vacuum source is turned off, and hose 12 is returned to hose compartment 40 by moving switch 78 to the "reverse" position. Door 82 may then be closed to hide nozzle 76 and any attachments stored in nozzle/retractor compartment 42. If a malfunction of the hose storage should occur, the unit can be serviced by removing cover 84.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A housing mountable within a wall including spaced parallel studs to connect a vacuum hose to a remote vacuum source comprising:

a) a convertible housing insertable between two of said studs, said housing having side walls with inner faces, top and bottom walls with inner faces and a vertical rear wall;

b) a horizontal divider with an upper surface extending between said side wall inner faces to form upper and lower compartments, said divider including a first opening between said upper and lower compartments, said lower compartment including an external connection opening through one of said side walls;

c) a removable vertical partition wall extending between the top wall inner face to the horizontal divider upper surface, dividing said upper compartment into first and second sections, said vertical partition wall having a second opening between said first and second sections;

d) a hose inlet connector in said second opening; and e) a removable connector conduit extending from said inlet connector through said horizontal divider opening to said side wall external connection opening.

2. The housing of claim 1, further including mounting flanges extending outwardly from said side, top and bottom walls.

3. The housing of claim 1, including a hinged door over said first section.

4. The housing of claim 1, including a removable cover over said lower compartment.

5. A vacuum hose storage unit mountable within a wall to connect a vacuum hose to a remote vacuum source comprising:

a) a convertible housing having a rear wall, side walls, a top wall and a bottom wall, said walls together defining an interior chamber, and a horizontal chamber divider having an upper surface extending across said interior chamber to divide said interior chamber into first and second compartments, said divider including a hose opening between said first and second compartments, one of said walls including an external connection opening in said second compartment;

b) a hose inlet connector over said external connection opening;

c) a flexible vacuum hose having a stored position in said second compartment, and an extended position, said hose having a proximal end attached to said inlet connector, and a nozzle end in said first compartment when said hose is in the stored position; and d) a reversible hose retractor supported on said horizontal divider upper surface within said first compartment to move said hose between said stored and extended positions, said retractor further including first and second hose guides, said first guide directs said hose through said divider opening and said second guide directs said hose parallel to said divider.

6. The unit of claim 5, wherein said retractor is in said first compartment.

7. The unit of claim 5, wherein said divider extends horizontally across said chamber between said chamber side walls, said second compartment being beneath said divider.

8. The unit of claim 5, wherein said retractor included first and second opposed rollers with parallel axes, said rollers being moveable between an open position for insertion of said hose, and a closed position in which said hose is between and in contact with said rollers.

9. The unit of claim 5, wherein said retractor includes a first face extending into said first compartment, and a second face toward said second compartment, said hose extending from said first face to said second face.

10. The unit of claim 5, wherein said hose includes a nozzle attached to said nozzle end, said nozzle including a switch to control said retractor.

11. The unit of claim 5, wherein said first compartment has a nozzle side and a retractor side, said nozzle side being covered by a hinged cover.

12. A vacuum hose storage unit mountable within a wall to store a vacuum hose, and to connect the vacuum hose to a remote vacuum source comprising:

a) a convertible housing having a rear wall, side walls, a top wall and a bottom wall, said walls together defining an interior chamber, and a chamber divider with upper surface extending horizontally across said interior chamber to divide said interior chamber into an upper nozzle/retractor compartment having a nozzle side and a retractor side, and a lower hose storage compartment, said divider including a hose opening between said nozzle/retractor compartment retractor side and said hose compartment, one side wall of said hose compartment including an external conduit connection opening;

b) a hose inlet connector at said external conduit connection opening;

c) a reversible hose retractor supported on said horizontal divider upper surface within the retractor side of said nozzle/retractor compartment;

d) a flexible vacuum hose extending through said retractor from the nozzle side of said nozzle/retractor compartment to the inlet connector in said hose compartment.

13. The unit of claim 12, wherein said retractor has a first face toward said nozzle side and a second face toward said hose compartment, said hose extending through said first and second faces.

14. The unit of claim 12, wherein said retractor included first and second opposed rollers with parallel axes, said rollers being moveable between an open position for insertion of said hose, and a closed position in which said hose is between and in contact with said rollers.

15. A method of installing a vacuum hose storage unit within a wall, said wall having a pair of spaced vertical studs and a wall covering, comprising:

a) providing a housing having a rear wall, side walls, a top wall and a bottom wall, said walls together defining an interior chamber, and a chamber divider extending across said interior chamber to divide said interior chamber into a nozzle/retractor compartment having a nozzle side and a retractor side, and a hose storage compartment, said divider including a hose opening between said nozzle/retractor compartment retractor side and said hose compartment, one wall of said hose compartment including an external conduit connection opening;

b) providing a reversible hose retractor;

c) providing a flexible vacuum hose having a nozzle end and a connection end;

d) providing a hose inlet connector;

e) mounting said housing in said wall between said studs;

f) attaching said inlet connector to said conduit connection opening;

f) attaching said retractor to said hose;

g) inserting said hose through said divider hose opening and attaching the connection end of said hose to said inlet connector;

h) inserting said retractor into the nozzle side of said nozzle/retractor compartment, and then moving said retractor to the retractor side of said nozzle/retractor compartment.

16. The method of claim 15, wherein said retractor side of said nozzle/retractor compartment is covered with a wall covering material before insertion of said retractor into the retractor side of the nozzle/retractor compartment.

17. The method of claim 15, further including the steps of providing a hinged door, and attaching said hinged door over the nozzle side of said nozzle/retractor compartment.

18. The method of claim 15, further including the steps of mounting a second inlet connector in said nozzle/retractor compartment and connecting an internal conduit between said second inlet connector and said connection opening, and thereafter removing said second inlet connector and said internal conduit before insertion of said hose and said retractor.

* * * * *